US006715314B2

(12) United States Patent
Rose

(10) Patent No.: US 6,715,314 B2
(45) Date of Patent: Apr. 6, 2004

(54) INTERCHANGEABLE RING SYSTEM

(76) Inventor: Laura Jeanene Rose, 5377 Romford Dr., San Jose, CA (US) 95124

( * ) Notice: Subject to any disclaimer, the term of this patent is extended or adjusted under 35 U.S.C. 154(b) by 90 days.

(21) Appl. No.: 10/206,544

(22) Filed: Jul. 26, 2002

(65) Prior Publication Data

US 2004/0016261 A1 Jan. 29, 2004

(51) Int. Cl.[7] ..... A44C 17/02

(52) U.S. Cl. ..... 63/29.1; 63/1.11; 63/1.16; 63/15

(58) Field of Search ..... 63/1.11, 1.16, 63/15, 29.1

(56) References Cited

U.S. PATENT DOCUMENTS

| | | | | | |
|---|---|---|---|---|---|
| 367,449 | A | * | 8/1887 | Scott | 63/29.1 |
| 700,637 | A | * | 5/1902 | Frey, Jr. | 63/29.1 |
| 766,435 | A | * | 8/1904 | Fitzgerald | 63/29.1 |
| 1,052,141 | A | * | 2/1913 | Gaschke | 63/29.1 |
| 2,316,225 | A | * | 4/1943 | Hoffman et al. | 63/29.1 |
| 2,775,878 | A | * | 1/1957 | Eichhorn | 63/29.1 |
| 3,133,331 | A | * | 5/1964 | Marticorena | 24/609 |
| 3,933,011 | A | | 1/1976 | DiGilio et al. | |
| 4,374,470 | A | | 2/1983 | Isaacson | |
| 4,393,667 | A | * | 7/1983 | Reinstein et al. | 63/29.1 |
| 4,742,696 | A | | 5/1988 | Jenkins | |
| 4,794,766 | A | | 1/1989 | Schunk et al. | |
| 4,905,482 | A | | 3/1990 | Gheblikian | |
| 5,077,989 | A | | 1/1992 | Dillabaugh | |
| 5,133,195 | A | * | 7/1992 | Appelbaum et al. | 63/29.1 |
| 5,228,317 | A | | 7/1993 | Hendricks | |
| 5,357,770 | A | | 10/1994 | Lanyi | |
| 5,375,434 | A | | 12/1994 | Wertheimer et al. | |
| 5,456,095 | A | | 10/1995 | Tawil et al. | |
| 5,491,986 | A | | 2/1996 | White | |
| 5,588,310 | A | | 12/1996 | Lai | |
| 5,727,399 | A | | 3/1998 | Bergagnini | |
| 5,806,345 | A | | 9/1998 | Bonchek | |
| 5,865,042 | A | | 2/1999 | Cerqua | |
| 5,996,374 | A | | 12/1999 | Bardisbanyan | |
| 6,116,054 | A | | 9/2000 | Czupor | |
| 6,131,408 | A | | 10/2000 | Gill | |
| 6,192,708 | B1 | | 2/2001 | Mitchell | |

OTHER PUBLICATIONS

Seidengang Designs Flip–Ring. See: http://www.seidengangdesigns.com, and go to the product catalog for rings in the classic collection.

* cited by examiner

*Primary Examiner*—Andrea Chop

(57) ABSTRACT

Interchangeable Ring System for creating custom ring assemblies (20). Custom ring assemblies (20) are comprised of an interchangeable ring shank assembly (22) and an interchangeable ring ornament assembly (24). Interchangeability is achieved through the connection of a male interchangeable mechanism (46) comprising a hinge (52), projection (54), and locking notch (56), to a female interchangeable mechanism (34) comprising a slot (38) and a slot enclosure (36 and 40).

12 Claims, 5 Drawing Sheets

INTERCHANGEABLE RING SYSTEM

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to the jewelry industry, specifically a ring that employs the use of a mechanism which allows the ornamental part of the ring to be interchanged.

2. Discussion of Prior Art

The adornment of various parts of the body with jewelry is a concept that predates recorded history. In modem times, most jewelry designs include some sort of gemstone set in a mounting, possibly attached to some sort of aesthetic design element (e.g. engraving, finish, etc.). The mounting, the gemstone, the aesthetic design, and the functional components (e.g. additional material to attach the item to the human body, etc.) are typically fashioned in such a way that they form a single static unit. That is, the gemstone is permanently set in the mounting, and the mounting is permanently attached to the rest of the piece (i.e. attached to a ring shank or an earring post). This provides the jewelry wearer with one look for every item purchased. Thus, there is a need for jewelry which enables a more economic and personalized jewelry experience, where one jewelry purchase can provide many different looks.

Various enhancements to this static jewelry style for rings have been proposed in the prior art. Many of the designs in the prior art focus on the exchange of the ring's gemstone itself, and therefore modify the mechanical design of the mounting by adding a grasping mechanism to hold and release the gemstone. Generally speaking, this means that the jewelry user is manipulating loose gemstones, many of which are small and/or not colored (e.g. diamonds, etc.) and are therefore difficult to see. Thus, this kind of design increases the likelihood that an expensive gemstone can be lost. Examples of such designs are U.S. Pat. Nos. 5,375,434 Wertheimer (1994), U.S. Pat. No. 4,794,766 Schunk et al. (1989), and U.S. Pat. No. 4,742,696 Jenkins (1988).

It is easier to accomplish some degree of interchangeability at the expense of functionality, as can be seen in U.S. Pat. No. 6,131,408 Gill (2000) and U.S. Pat. No. 6,192,708 B1 Mitchell (2001). These designs have foregone the interchangeability of the main ornamental section of the ring, and have instead chosen to only allow for the insertion of side adornments. While these designs accomplish their goal well, they do not meet the challenge of interchanging the entire center ornamental section.

Other prior art does focus on the interchangeability of larger sections of the ring, such as the setting and the stone together in one unit. Through time, there has been a steady progression of designs which seek to achieve this functionality while being both aesthetically pleasing and easy to use. However, it is difficult to devise a mechanism which provides the interchangeability without affecting the aesthetic nature of the jewelry in a manner that doesn't burden the user with complex and costly mechanisms. Many of these prior designs have created mechanisms that unfortunately add substantial bulk to the center section of the ring. Since jewelry is a fashion item, the look of the piece is very important, and any additional mass areas, lines, creases, cracks, gaps, hinges, clasping mechanisms, etc., which are visually present and/or obtrusive to the observer will detract significantly from the desirability and thus the marketability of the design.

U.S. Pat. No. 3,933,011 DiGillio et al. (1976), and U.S. Pat. No. 5,456,095 Tawil et al. (1995) are both variations on a theme of a keyed mechanism which, while unique, contains a great deal of intricate mechanisms which are very difficult to manufacture and thus pass on high costs to the consumer. U.S. Pat. No. 4,905,482 Gheblikian (1990) and U.S. Pat. No. 5,228,317 Hendricks (1993) are also variations on a theme, but of a center section that slides in and out of a slot. The difficulty inherent in these designs is the lack of a definite securing mechanism. That is, the interchangeable piece is secured via a secondary means by closing something over the slot, rather than by securing the piece itself. This leads to excessive movement of the piece while in use. U.S. Pat. No. 4,374,470 Isaacson (1983) shows a design with a similar problem wherein the center piece enters the slot from below and a door is closed underneath it.

The lack of a successful design which is both functional and aesthetically pleasing is made clear by research into the commercial jewelry market. To the applicants' knowledge, there are virtually no jewelry designs being successfully marketed and sold of this type. This is because the jewelry user will not buy a piece that sacrifices look for function.

Lacking in all of the prior art is a ring concept that allows the jewelry user to mix and match center ornamental sections into any number of custom assemblies while doing so in a manner that is secure, durable, easy to manufacture, and aesthetically pleasing. Thus the need still exists for a system of jewelry which the jewelry wearer will find flexible in final assembly, while retaining the visual appeal that is so important in this fashion industry. This invention addresses those needs.

BACKGROUND—OBJECTS AND ADVANTAGES

Accordingly, several objects and advantages of the present Patent Application of Laura J. Rose for "Interchangeable Ring System" are:

(a) to provide an interchangeable mechanism which is easy to use;

(b) to provide an interchangeable mechanism which is secure;

(c) to provide an interchangeable mechanism that does not require the user to manipulate small parts which can be lost;

(d) to provide a system of interchangeability which minimizes the aesthetic impact of the interchangeable mechanism (i.e. hidden from ordinary view);

(e) to provide an interchangeable mechanism which exhibits mechanical integrity;

(f) to provide an interchangeable mechanism which is both durable and yet easy and inexpensive to replace should it somehow be broken;

(g) to provide all of the above advantages with an interchangeable mechanism that is easy and inexpensive to manufacture, so that cost savings can be passed to the consumer.

Further objects and advantages include:

1) the ability to interchange stone colors without resorting to complex and difficult to use gemstone grasping mechanisms;
2) the ability to interchange the entire center ornamental section of the ring and not just peripheral adornments;
3) the ability of the jewelry user to wear a piece created through this interchangeable design without the negative visual impact created by obtrusive hinges, clasps, mass areas, etc.;
4) an interchangeable design which does not rely on a user's guess as to the tightness of the contact (e.g. screw/thread mechanism)—a successful closure can be felt/heard.

A significant object and advantage that should be particularly noted is the unobtrusive nature of the interchangeable design, and particularly the visual concealment of the interchangeable mechanisms when in the connected state. If these mechanisms are not hidden from ordinary view (both direct view and indirectly wherein there is added visual mass under which the mechanisms reside), they will lessen the visual appeal of the jewelry item, and thus the marketing appeal of the interchangeable ring design. Still further objects and advantages will become apparent from a consideration of the ensuing description and drawings.

SUMMARY

The interchangeable nature of the ring detailed in this Patent Application of Laura J. Rose for "Interchangeable Ring System" allows the jewelry wearer to create a unique custom ring assembly which can be coordinated to the user's desires (e.g. general taste, outfit being worn, color coordination, event attended, etc.). The segmenting of the ring sections and the design of the interchangeable mechanism affords the user this flexibility while providing ease of use in a durable and affordable manner. In accordance with the present invention, the following definitions are made:

(1) Custom Ring Assembly—User-assembled custom ring design consisting of both an interchangeable ring shank assembly and an interchangeable ring ornament assembly.
(2) Interchangeable Ring Shank Assembly—The segment of the ring that encircles the finger, and contains one sex of the interchangeable mechanism.
(3) Interchangeable Ring Ornament Assembly—The segment of the ring that contains the main center ornament and the other sex of the interchangeable mechanism.
(4) Interchangeable Mechanism—The mechanism in accordance with the present invention which consists of:
   (a) A female mechanism—the preferred embodiment of said female mechanism is comprised of a base area, or slot floor, slot walls, and a slot roof, all of which serve to enclose a slot volume devoid of material. The slot accepts a projection from the male mechanism which is secured within the slot floor, roof, and walls. The slot walls and slot roof can be created in such a manner as to form overhangs, instead of a continuous roof of material, which serve the same purpose of enclosing the slot.
   (b) A male mechanism—the preferred embodiment of said male mechanism is comprised of a locking notch and a flat projection which is attached to a hinge. The projection fits into the female mechanism and locks over the locking notch.

The male mechanism from one component connects into the female mechanism from the other component, thus interlocking the interchangeable ring shank assembly and the interchangeable ring ornament assembly together. Either the male or the female mechanism may be present on either the interchangeable ring shank assembly or the interchangeable ring ornament assembly.

DRAWINGS—FIGURES

In the drawings, closely related figures have the same number, but different alphabetic suffixes. Note that all figures depict the preferred embodiment only.

Figure 2:
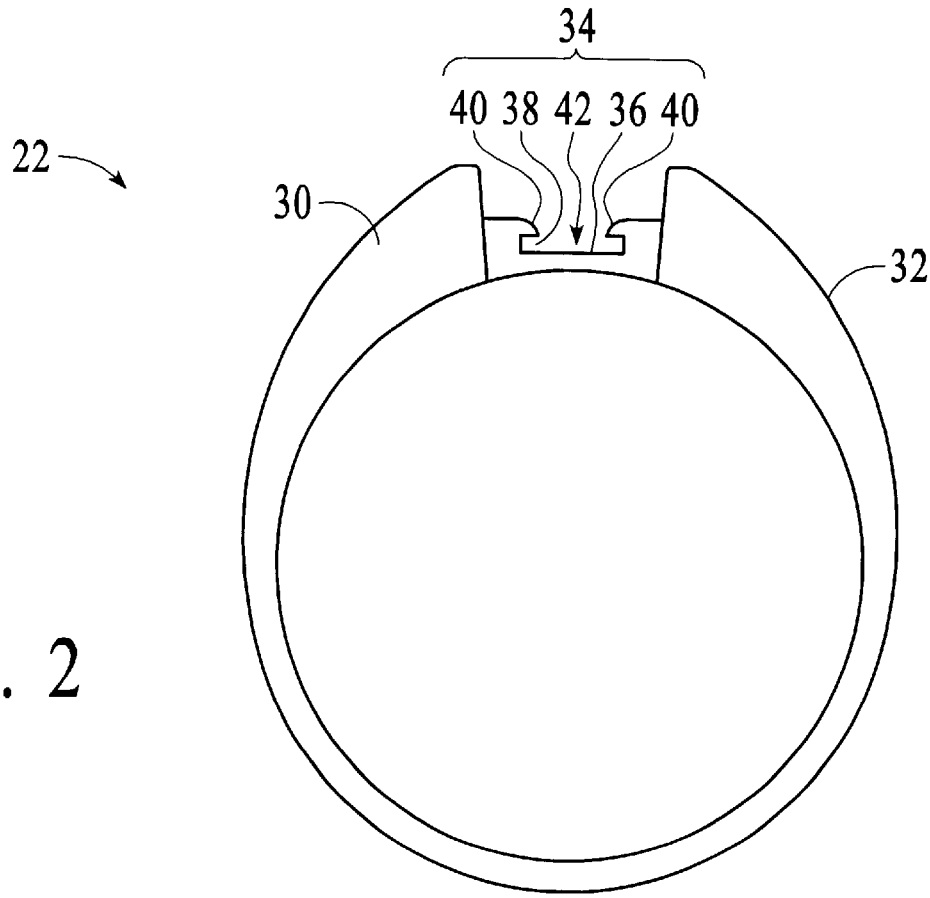
FIG. 2 shows a front view of an interchangeable ring shank assembly possessing the female interchangeable mechanism.
Figure 3:
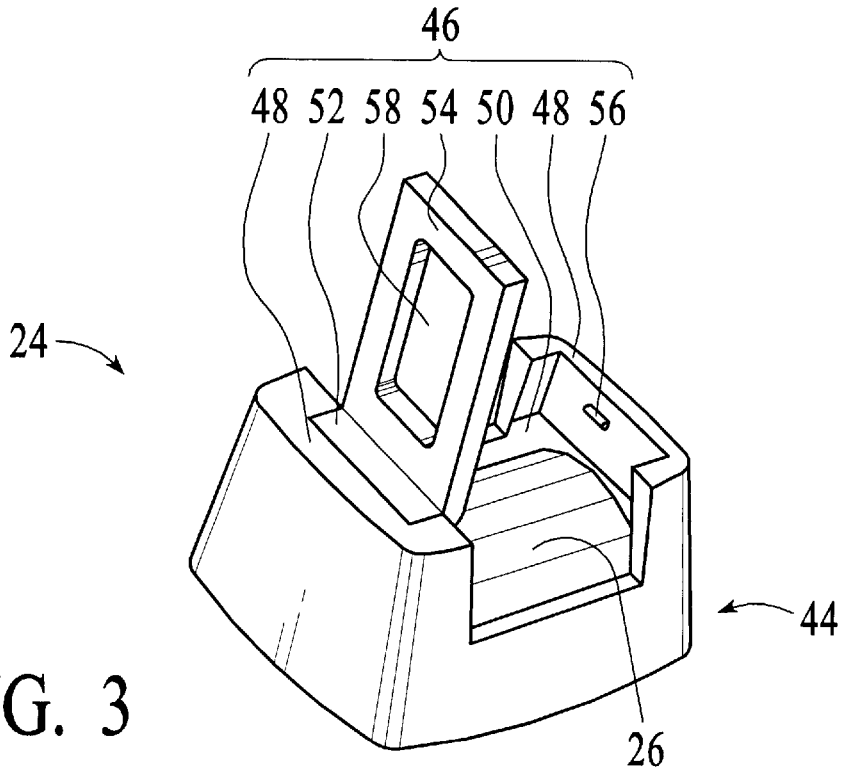
FIG. 3 shows a top perspective view of the underside of an interchangeable ring ornament assembly possessing the male interchangeable mechanism.
Figure 4A:
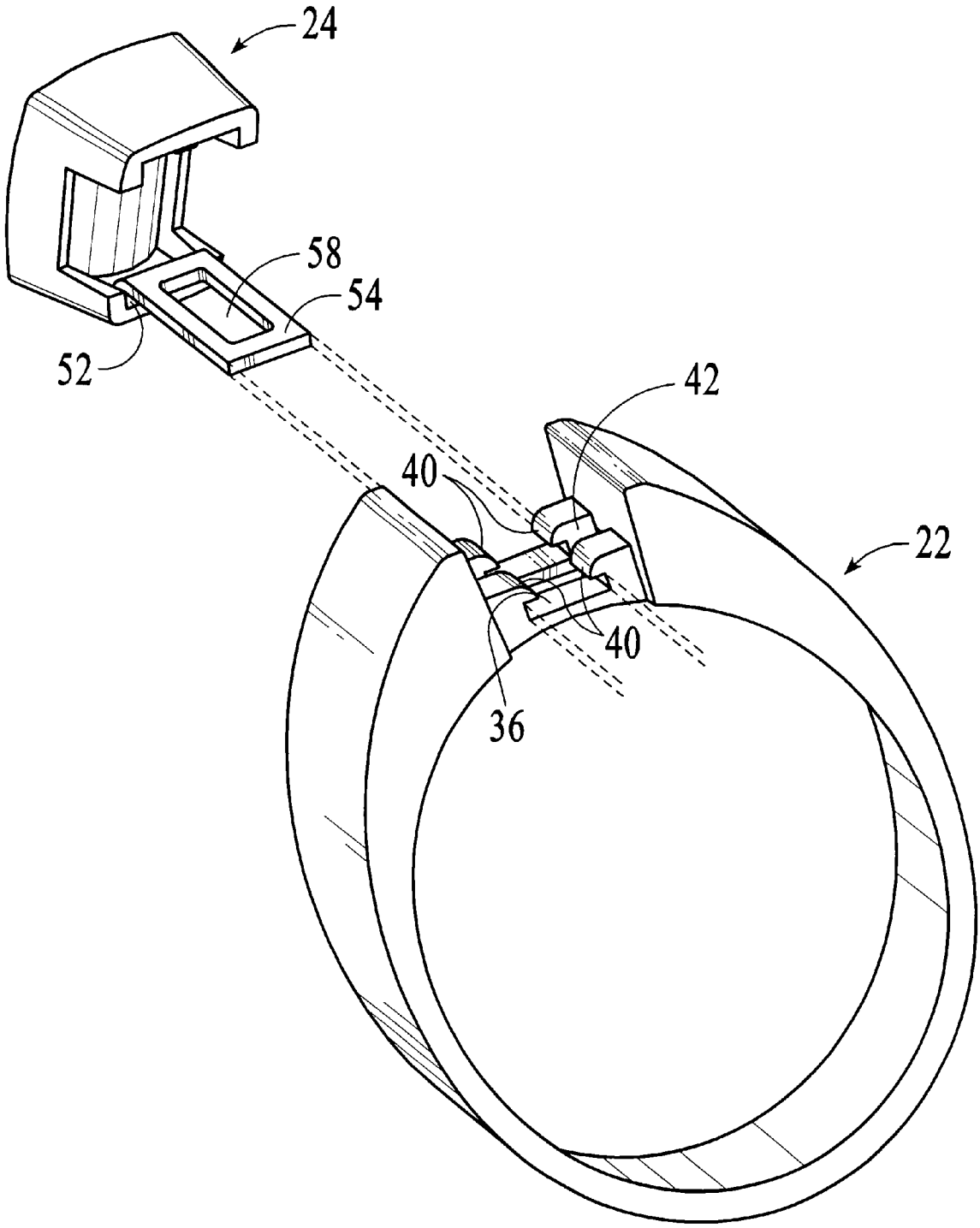
Figure 4B:
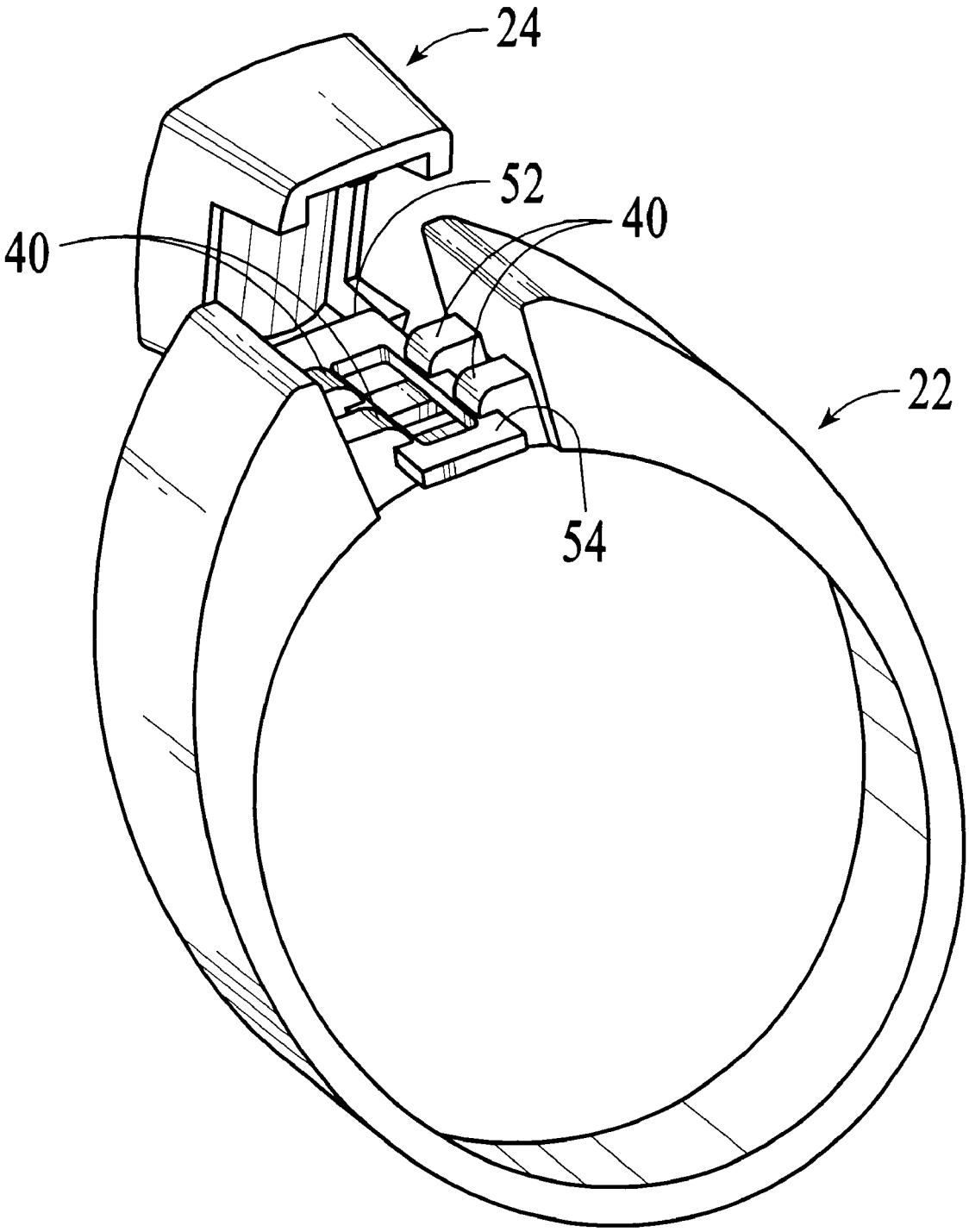
Figure 4C:
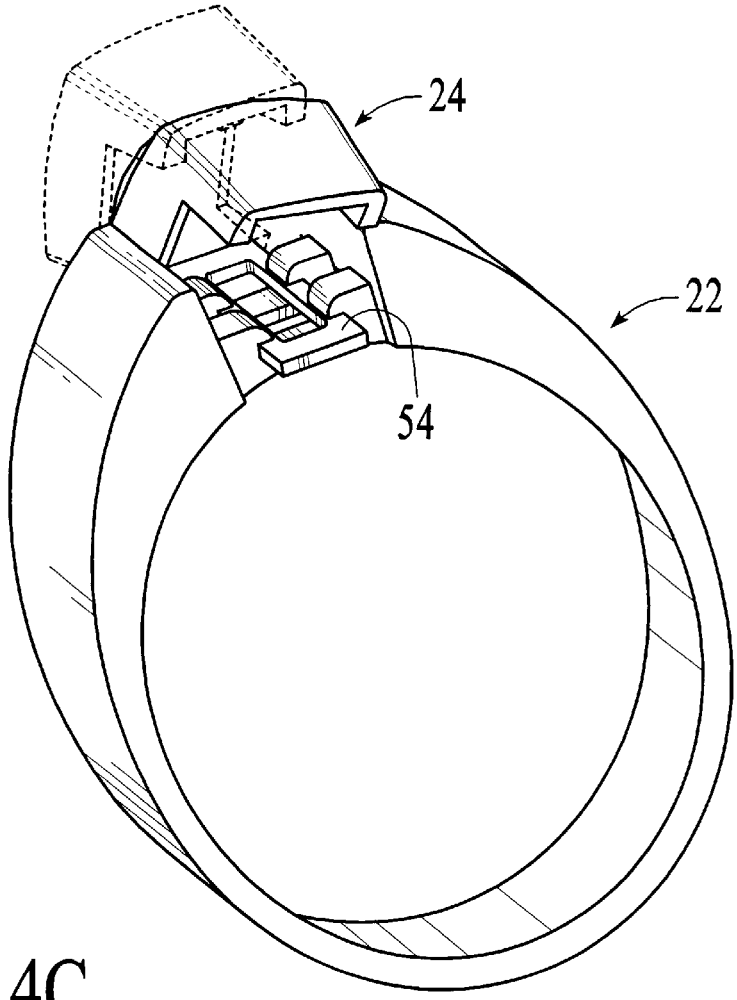

FIGS. 4A, 4B, and 4C show the interchangeable ring shank assembly of FIG. 2 and the interchangeable ring ornament assembly of FIG. 3 in the main sequential positions undergone to become securely interconnected.

Figure 5A:
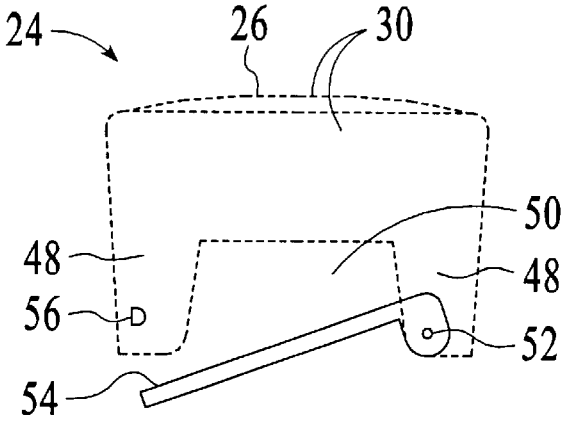
Figure 5B:
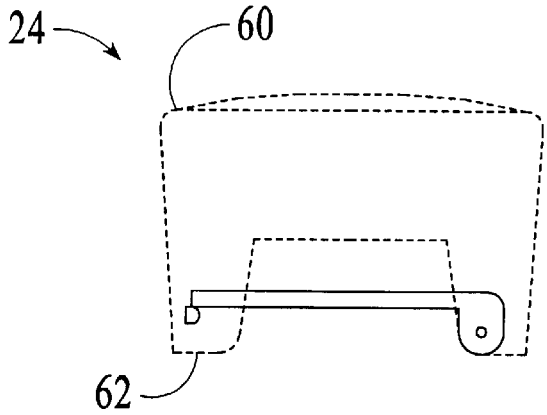

FIGS. 5A and 5B show a more detailed "see-through" view of the before and after securement positions for the projection and locking notch components, since they are visually concealed under ordinary circumstances.

DRAWINGS—REFERENCE NUMERALS

20-Custom Ring Assembly
22-Interchangeable Ring Shank Assembly
24-Interchangeable Ring Ornament Assembly
26-Gemstone
28-Gemstone mounting
30-Design Element
32-Shank
34-Female Interchangeable Mechanism
36-Slot Floor Base
38-Slot
40-Overhang Projections (Slot Roof and Slot Walls)
42-Female Cutout
44-Ornament
46-Male Interchangeable Mechanism
48-Underside Walls
50-Enclosure
52-Hinge
54-Projection
56-Locking Notch
58-Male Cutout
60-Press Down Area
62-Pull Up Area

DETAILED DESCRIPTION—FIGS. 1 THROUGH 5B—PREFERRED EMBODIMENT

Figure 1:
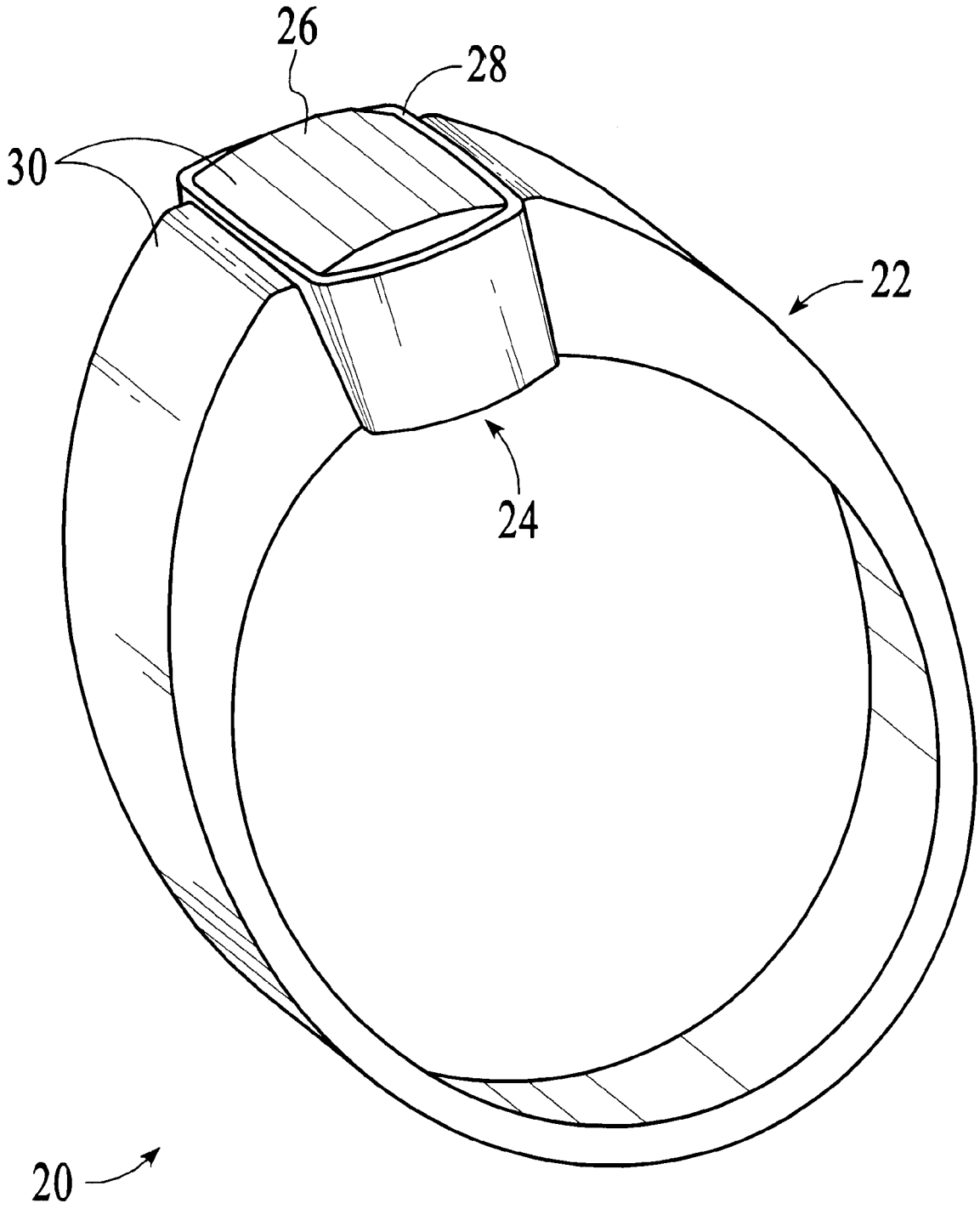
FIG. 1 shows a perspective view of a custom ring assembly. Note that the interchangeable mechanisms are visually concealed when the segments are connected to one another (i.e. the absence of obtrusive clasping mechanisms).

A custom ring assembly 20 is depicted in FIG. 1. This preferred embodiment of Interchangeable Ring System consists of an interchangeable ring shank assembly 22 and an interchangeable ring ornament assembly 24. It should be noted that the interchangeable mechanisms are not visible in this fully assembled state.

Also shown in FIG. 1 are the gemstone 26, the gemstone mounting 28, and the design element 30. The gemstone 26, the mounting 28, and the design element 30, noted also on FIGS. 2 and 5A, are all optional components on both the shank assembly 22 and the ornament assembly 24. As can be seen throughout the figures, the design element 30 can be present in or on any part(s) of a custom ring assembly 20, and can be of any manifestation. For example, the design element might consist of an engraving, a metal finish, gemstones, or some form of non-interchangeable assembly structurally associated with either the shank assembly 22 or the ornament assembly 24. The gemstone 26 itself, as well as other gemstones can be considered part of the design element 30 of the custom ring assembly.

FIG. 2 shows an individual interchangeable ring shank assembly 22, consisting of a shank 32 which provides encirclement of a finger, and a female interchangeable mechanism 34. In the unconnected state, the female interchangeable mechanism 34 is now observable. The female mechanism 34 consists of a base area, or slot floor 36, a slot 38, and two overhang projections 40. Note that the projections 40 are one embodiment of a more general slot roof and slot walls. In this more general case, there is a solid slot roof above the slot 38 and the slot floor 36, and thus the slot floor 36, the slot walls, and the slot roof provide the enclosure for the slot 38. The shank 32 encircles a majority of the finger, except for the top of the shank assembly 22, where the female interchangeable mechanism 34 resides. At this point, the slot floor 36 bridges the gap between the two ends of the shank 32. The slot floor 36 also extends a non-specific distance from the near end to the far end of the shank 32. This distance need only be long enough to provide mechanical stability when the custom ring assembly 20 is fully assembled.

Above the slot floor 36 is the slot 38. This is a region devoid of material in which part of the male interchangeable mechanism will lie. Above the slot 38 are the overhang projections 40. These overhangs 40 have an underside surface that, when coupled with the slot floor 36 and the slot 38, provide an enclosure for the male interchangeable mechanism to securely rest. In the preferred embodiment, the slot region takes the general outline of a rectangular parallelepiped, but more generally can be of any shape.

There can be one or more cutouts 42 cut through both the overhang projections 40 and the slot floor 36. These cutouts 42, which are labeled, but not shown, in FIG. 2, can be seen in FIGS. 4. These cutouts 42 should be small enough so as to not adversely affect the mechanical integrity of the female interchangeable mechanism 34. Note that the cutout 42 splits the overhangs 40 on each side into multiple overhangs. The splitting of these overhangs 40 is accomplished in a manner so as to not to affect the mechanical integrity of the female interchangeable mechanism.

FIG. 3 shows an individual interchangeable ring ornament assembly 24, which consists of an ornament 44 and a male interchangeable mechanism 46. The ornament 44 is for decorative and aesthetic purposes, and as such, can possess any sort of design element 30 (e.g. engraving, metal finish, decorative gemstones, center gemstone 26, etc.) Note that FIG. 3 shows the underside of the ornament 44 in an embodiment which possesses a center gemstone 26.

The ornament assembly 24, has projecting downward from its top surface, underside walls 48. These walls 48 provide a small enclosure area 50 on the underside of the ornament assembly 24. This enclosure 50 has inside it on one wall a hinge 52, and on the opposite wall a locking notch 56. The notch 56 is a mass of material mounted to the inside surface of the enclosure 50, running parallel to the surface of the ornament assembly 24. The hinge 52, has a projection 54 attached to it which can rotate within the confines of the enclosure 50 such that it is either parallel or perpendicular to the top of the ornament assembly 24. One or more cutouts 58 may be present within the projection 54. These cutouts 58 should be small enough so as to not affect the mechanical integrity of the male interchangeable mechanism 46. The outer cross sectional dimensions of the projection 54 are such that the projection 54 can fit securely within the slot 38 of the female interchangeable mechanism 34. As such, in the preferred embodiment, the projection 54 takes the general outline of a rectangular parallelepiped, but more generally can be of any shape.

It should be generally understood throughout this patent and the above description that all items are attached to relevant adjacent items by some means commensurate with the materials of which they are made (e.g. metalworking if items are made from metal).

It should be noted that the shank 32 is not explicitly described in that it is generally understood to be of a nature that is within the public domain. The extent to which it is a part of this patent is limited to its presence on said shank assembly 22 and to its possibly possessing some aspect of the design element 30.

OPERATION OF INVENTION—PREFERRED EMBODIMENT

The operational description of Interchangeable Ring System will focus of the operation of the preferred embodiment of the male 46 and female 34 interchangeable mechanisms by considering the series shown in FIGS. 4 and 5.

Operation of the preferred embodiment of the interchangeable mechanisms is very simple. As shown in FIG. 4A, the projection 54 of the male interchangeable mechanism 46 should be rotated about the hinge 52 outward such that it is near its limit of being perpendicular to the top surface of the interchangeable ring ornament assembly 24. As FIG. 4A shows, the entire ornament assembly 24 is placed relative to the interchangeable ring shank assembly 22 such that the projection 54 is in a position to be able to slide into the slot 38 of the female interchangeable mechanism 34.

FIG. 4B shows the projection 54 now fully within the slot 38. The slot floor 36 and the overhangs 40 securely enclose the projection 54 from moving in any direction other than from where it came. With the projection 54 now secured in place, the ornament assembly 24 can be rotated about the hinge 52, as shown in FIG. 4C, such that the end of the projection 54 farthest from the hinge 52 comes in contact with the locking notch 56 on the underside of the ornament assembly 24.

FIGS. 5A and 5B show the before closure and after closure positional relationships of the projection 54 and the locking notch 56 on the underside of the interchangeable ring ornament assembly 24. Note that these positions are not directly observable due to the desired concealment of the interchangeable mechanisms in the assembled state. The locking notch 56 is of a size that is small enough to allow the projection 54 to snap past it without too much force, but also large enough to securely hold the projection 54 in the secured position until it is purposefully disengaged. The male mechanism 46 is secured (moving from position shown in FIG. 5A to the position shown in FIG. 5B) by pressing down on the top of the ornament assembly 24 in the vicinity of point 60 such that the projection 54 snaps past the locking notch 56. To disengage the locking notch 56, the ornament assembly 24 is lifted in the vicinity of point 62 such that the projection 54 snaps out from underneath the locking notch 56.

CONCLUSION, RAMIFICATIONS, AND SCOPE OF INVENTION

Thus, the reader will see that the Interchangeable Ring System described herein provides a highly flexible, unobtrusive, easy-to-use, and affordable system, which fills a marketplace need for dynamic jewelry that the wearer can personalize.

While the above description contains many specificities, these should not be construed as limitations on the scope of the invention, but rather as an exemplification of one preferred embodiment thereof. For example:

(1) The interchangeable ring shank/ornament assemblies may or may not contain gemstones; if not, they may consist entirely of different materials (gold, silver, etc.) possibly with some other kind of design element present;

(2) Gemstones which optionally reside in the interchangeable ring shank/ornament assemblies may be set or held in place in any fashion (e.g. prong-set, bezel-set, etc.);

(3) The projection on the male interchangeable mechanism and the corresponding slot on the female interchangeable mechanism do not have to be of a rectangular parallelepiped shape. Rather they can be of any shape (e.g. cylindrical, hexagonal, etc.);

(4) There can be more than one projection/slot combination in any given male/female interchangeable mechanism;

(5) There can be more than one interchangeable ring ornament assembly connected to an interchangeable ring shank assembly;

(6) The female interchangeable mechanism may reside on the interchangeable ring ornament assembly;

(7) The male interchangeable mechanism may reside on the interchangeable ring shank assembly;

(8) The interchangeable mechanisms may be constructed in such a fashion that the shank assembly and ornament assembly are at any given angle with respect to one another;

(9) The male and female cutouts need not be present;

(10) The male and female cutouts can be larger or more numerous;

(11) The overhang projections are one embodiment of a more general slot roof and slot walls. If material is not removed from the slot roof, the enclosure for the slot is provided by the slot floor, slot walls, and slot roof;

(12) The overhang projections, if present as such, can be of any shape;

(13) The locking notch can be replaced by any mechanism which secures the projection and thus the ornament assembly to the shank assembly. This includes, but is not limited to, magnet, button, snap, or latch closures;

Accordingly, the scope of the invention should be determined not by the embodiment(s), but by the appended claims and their legal equivalents.

What is claimed is:

1. A system of jewelry, comprised of the following:

a. an interchangeable ring shank assembly which is comprised of a shank for encircling a finger, and having vertical walls;

b. an interchangeable ring ornament assembly which is comprised of an ornament for visual appeal, said ornament assembly having substantially vertical walls extending normal to the ornament and located beneath the ornament to define an area beneath the ornament enclosed by the said vertical walls;

c. a female interchangeable mechanism, located on one of said interchangeable ring shank assembly or said interchangeable ring ornament assembly, which is comprised of a base area, or slot floor, slot walls, and a slot roof, all of which serve to define a slot and enclose a slot region;

d. a male interchangeable mechanism, located on the other of said interchangeable ring shank assembly or said interchangeable ring ornament assembly, which is comprised of a projection connected to a hinge which is located on one of said vertical walls; and a projection securing mechanism which the projection can be locked into, said securing mechanism positioned on one of said vertical walls different from the vertical wall upon which said hinge is connected;

wherein said projection fits within said slot region and said projection locks into said projection securing mechanism, said vertical walls substantially visually concealing said slot region, the hinge and the projection securing mechanism when said projection and said slot are connected to one another, the hinge and the projection securing mechanism being completely enclosed within said vertical walls and not being visible from any viewing angle, and so that the only angle from which the slot region can be seen is from directly beneath the ring shank which in normal use is concealed by a ring user's finger.

2. The system of jewelry of claim 1 wherein the male interchangeable mechanism is structurally connected to the side of the interchangeable ring ornament assembly underneath the ornament, and the female interchangeable mechanism is structurally connected to the interchangeable ring shank assembly.

3. The system of jewelry of claim 1 wherein the female interchangeable mechanism is structurally connected to the underside of the interchangeable ring ornament assembly underneath the ornament, and the male interchangeable mechanism is structurally connected to the interchangeable ring shank assembly.

4. The system of jewelry of claim 1 wherein the shape of said slot is approximately a rectangular parallelepiped.

5. The system of jewelry of claim 1 wherein said slot lies in the plane of a tangent to a circle formed by said shank when said projection and said slot are connected to one another.

6. The system of jewelry of claim 1 wherein said slot roof is cut away in such a fashion that said slot walls and said slot roof form overhang projections which still serve, with said slot floor, to enclose said slot.

7. The system of jewelry of claim 1 wherein said projection takes approximately the shape of a rectangular parallelepiped.

8. The system of jewelry of claim 1 wherein said projection securing mechanism takes approximately the shape of a ridge of material, or locking notch, over which said projection will snap.

9. The system of jewelry of claim 1 wherein one or more gemstones are structurally connected to said shank assembly.

10. The system of jewelry of claim 1 wherein one or more gemstones are structurally connected to said ornament assembly.

11. The system of jewelry of claim 1 wherein an aesthetic design element is applied to at least a portion of said shank assembly.

12. The system of jewelry of claim 1 wherein an aesthetic design element is applied to at least a portion of said ornament assembly.

* * * * *